US005841349A

United States Patent [19]

Holmgren

[11] Patent Number: 5,841,349

[45] Date of Patent: Nov. 24, 1998

[54] ALARM TAG

[76] Inventor: Bertil Holmgren, Rang Sandsvigen 59, S-235 91, Vellinge, Sweden

[21] Appl. No.: 732,358

[22] PCT Filed: Apr. 11, 1995

[86] PCT No.: PCT/SE95/00385

§ 371 Date: Dec. 20, 1996

§ 102(e) Date: Dec. 20, 1996

[87] PCT Pub. No.: WO95/27959

PCT Pub. Date: Oct. 19, 1995

[30] Foreign Application Priority Data

Apr. 12, 1994 [SE] Sweden ..... 9401218

[51] Int. Cl.[6] ..... G08B 13/14

[52] U.S. Cl. ..... 340/572

[58] Field of Search ..... 340/572, 568, 340/571

[56] References Cited

U.S. PATENT DOCUMENTS

| | | | |
|---|---|---|---|
| 4,000,543 | 1/1977 | Paskert | 340/572 |
| 4,156,302 | 5/1979 | Van Niel | 340/572 |
| 4,311,992 | 1/1982 | Dechant | 340/572 |
| 4,774,503 | 9/1988 | Bussard | 340/572 |
| 5,072,213 | 12/1991 | Close | 340/572 |
| 5,275,122 | 1/1994 | Stolz et al. | 116/200 |
| 5,367,289 | 11/1994 | Bard et al. | 340/572 |

FOREIGN PATENT DOCUMENTS

| | | |
|---|---|---|
| 0385540A1 | 2/1990 | European Pat. Off. . |
| WO 87/05136 | 1/1987 | WIPO . |
| WO 91/13416 | 2/1991 | WIPO . |
| WO 94/09479 | 10/1993 | WIPO . |

*Primary Examiner*—Jeffrey A. Hofsass
*Assistant Examiner*—John Tweel, Jr.
*Attorney, Agent, or Firm*—Joseph C. Mason, Jr.; Dennis G. LaPointe

[57] ABSTRACT

An alarm tag is provided having two parts, one of which has a pin attached thereto and extending through the part and into locking engagement with the other part. One part has means for activating an alarm device, the alarm device being either in the other part or an external alarm which interacts with the tag through an alarm field. Further, one part has a contact element operatively related to the other part such that disturbing the pin causes the contact to activate the alarm when the parts are separated.

9 Claims, 1 Drawing Sheet

ALARM TAG

The invention relates to an alarm tag comprising two parts one of which is provided with a pin attached to said one part to be located on one side of a product with the pin extending through the product into locking engagement with the other part located on the opposite aide of the product, said one part having means for activating an alarm device in said one part.

Existing alarm tags are of one or the other of two types. Either the alarm device is located in the alarm tag so that an alarm will be emitted from the alarm tag at theft of the protected product, or means in the alarm tag affect an external alarm device so that an alarm is emitted externally at theft. In both cases said one part has a completely passive element and comprises a head on the pin, most frequently of plastics, the only purpose of which is to maintain the alarm tag mechanically on the product. In both cases there are deficiencies regarding the securily against theft to be afforded by the alarm tag. Thus, it is possible to remove the alarm tag from the protected product by cutting off the pin or by crushing the plastic head, and if this is done no alarm will be given unless either the pin is withdrawn from the alarm tag or the alarm tag is carried into or out of an external field. It is thus possible to remove the alarm tag and then walk out carrying the product from the area protected against theft without an alarm being given.

The purpose of the invention is to provide an alarm tag which improves the security against unauthorized removal from the product to be protected against theft by means of the alarm tag of the kind referred to above according to the invention comprises two parts, one of which is provided with a pin attached to the one part to be located on one side of a product with the pin extending through the product into locking arrangement with the other part located on the opposite side of the product, the one part having means for activating an alarm device in the one part, characterized in that the one part comprises a bistable contact element operatively related to an electronic control circuit for the alarm device or a second alarm device, the contact element normally being in one stable position in which the alarm device is silent, but being constructed to be switched via the pin to the other stable position in order to activate the alarm device at the attempt to separate the two parts of the alarm tag.

Figure 1:
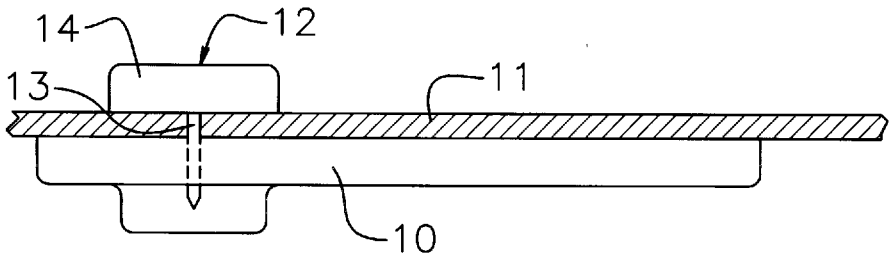
Figure 2:
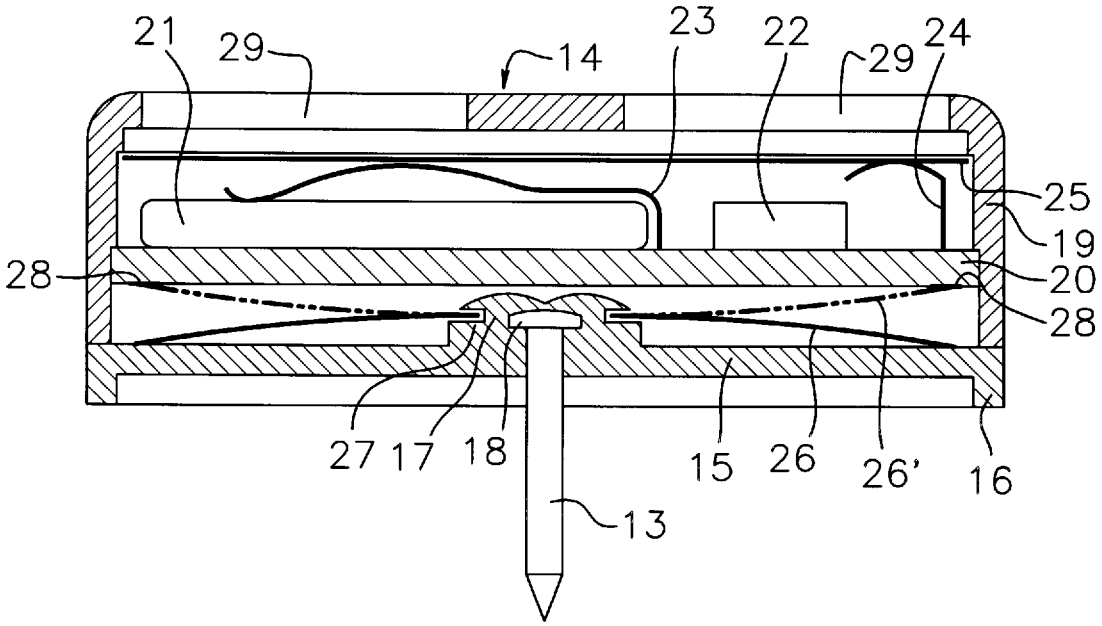

In order to explain the invention in more detail reference is made to the accompanying drawing which discloses an illustrative embodiment and wherein FIG. 1 is a side view of an alarm tag attached to a product which is shown fragmentarily in cross section, and FIG. 2 is an enlarged cross sectional view of that part of the alarm tag which comprises a pin and a head.

In FIG. 1 there is disclosed an alarm tag which comprises a first part 10 containing means for initiating alarm from an alarm device which either is built into this part or consists of an external alarm device. The alarm is initiated when the alarm tag is carried out from a defined area in a department store or a shop due to the fact that the alarm tag then, at the exit from said area, will leave of an electromagnetic or electrostatic field maintained in said area, or it; carried through such a field maintained between bows located one at each side of the exit passage. This part of the alarm tag can be of any existing known construction. Part 10 is applied to one side of a product 11. The alarm tag also comprises a second part 12 consisting of a pin 13 with a head 14 said head being applied to the opposite side of product 11 with the pin extending through the product and being attached to part 10. The attachment is such that the parts cannot be moved apart for removal of the alarm tag from the product unless the attachment is operated magnetically or mechanically in a special device at the site where the product is to be paid, according to a well-known technique applied in connection with alarm tags.

The invention is based on the knowledge that each attempt to move the two parts of the alarm tag apart or to cut off the pin by means of a cutter or the like which is inserted between the parts causes deforming forces on the parts. This is utilized according to the invention in order to emit an alarm from the alarm tag when such deforming forces act on the alarm tag. Instead of being constructed in a known manner as a plastic head the only purpose of which is to maintain in co-operation with part 10 and pin 13 the alarm tag on the product, head 10 contains according to the invention an auxiliary alarm device in addition to the alarm device provided in part 10 or externally, said auxiliary alarm device being constructed to be activated as soon as deforming forces occur in part 12.

Part 12 is shown in detail in FIG. 2 and as can be seen head 14 comprises a bottom plate 15 which has for example circular shape. Said plate preferably is made of plastics of such kind that the plate is impact resistant and elastically deformable and also can be fused. A suitable material is for example polycarbonate. The plate has a downwardly extending peripheral rim 16 which stiffens the plate at the periphery, and a central bulge 17 in which the pin in attached at a head 18 formed on the pin. A cylindrical cover 19 is fused to plate 15 and includes a circuit board 20 with a battery 21 and an electronic circuit 22 located on said board. Contact springs 23 and 24 maintain electric connection between the electronic circuit and the battery, respectively, and a sound membrane 25. This electronic alarm device can be constructed according to principles which are well known in connection with miniature electronic alarm devices and therefore will not be described in further detail.

A conductive bistable spring washer 26 of metal is located in the space defined between circuit board 20 and plate 15, and is attached at a central opening therein to the bulge 17 by the edge portion around the opening being received in a circular circumferential groove 24 in bulge 17. The spring washer functions as a contact clement for switching the electronic alarm circuit on and off and normally is in one stable position shown by solid lines, in which the spring washer in arched downwards and engages at the periphery thereof the upper surface of plate 15. When the spring washer is in this position the electronic circuit is de-energized and the alarm device accordingly is passive. Should plate 15 be deformed am can happen by the pin 13 being exposed to axial tension or by the pin being tilted this will cause the spring washer to snap to the other stable position thereof which is shown by dot and dash lines in FIG. 2. In this position the spring washer is arched upwards in order to engage at the periphery thereof the lower side of the circuit board 20 which has conductive contact surface 28 for closing the electronic circuit when the spring washer engages said contact surfaces. Then, the alarm device will activate the sound membrane 25 being induced to oscillate and to emit sound at a suitable frequency. In the cover 14 slots 29 are provided to "let out" the sound. Inside the cover there may be provided a resonance chamber for amplification of the generated sound.

If the alarm device has been activated it can be shut off by the spring washer being brought to snap back to the position shown by solid lines, but such resetting should of course be possible only in a device provided especially for that purpose by actuation of the spring washer.

The alarm device which in the illustrative embodiment is mounted in head 19 is an auxiliary alarm which will be activated as soon as plate 15 is deformed when somebody tries to remove the alarm tag from the protected product by manipulating the alarm tag. The alarm which sounds when somebody tries to carry away the product with the alarm tag attached thereto is emitted from part 10 or from an external alarm device and will be initiated in a known manner in co-operation with the external electromagnetic of electrostatic field. However, it is possible within the scope of the invention to have said latter alarm device activated also via the bistable contact element and in that case the auxiliary alarm device can be dispensed with.

As would be easily understood the electronic alarm circuit can be constructed in many different ways within the scope of the inventive concept. It would also be understood that the contact element need not be a bistable element but can be constructed to trigger an electronic circuit which keeps the alarm device activated after triggering. In the disclosed embodiment alarm will be given when an electric circuit is closed but it is also possible but less advantageous with regard to the power supply to have the spring washer keep an electric circuit closed when the alarm device is silent, alarm being given when said electric circuits is opened by the spring washer being switched.

I claim:

1. Alarm tag for a product comprising:

a first part to be located on one side of the product;

a pin attached to the first part, the pin extendible through the product when the first part is located on said one side of the product;

a second part to be located on the opposite side of the product for locking engagement with the pin of the first part;

means providing locking engagement between the pin and the second part;

an alarm device in said first part, the alarm device being electronically activated;

a power source for said alarm device in said first part;

an electronic control circuit in said first part for controlling interconnection of the power source and the alarm device;

a conductive first contact element integrally connected with the electronic control circuit; and a conductive second contact element wherein the second contact element is a bistable contact element in the first part, said bistable contact element having a first stable position which is the normal position thereof and in which the bistable contact element is separated from the first contact element, the electronically controlling interconnection thereby being interrupted and the alarm device being silent, and said bistable contact element having a second stable position in which the bistable contact element engages the first contact element, the electronically controlling interconnection thereby being closed and the alarm device being activated, the pin being operatively connected with the bistable contact element to switch momentarily the bistable element from the normal first stable position to the second stable position thereof in order to activate the alarm device at attempt to separate the first and second parts of the alarm tag when in locking engagement with each other.

2. Alarm tag according to claim 1 wherein the bistable contact element comprises a bistable spring washer.

3. Alarm tag according to claim 1 wherein the bistable contact element is arranged to be switched to the second stable position via the attachment of the pin.

4. Alarm tag according to claim 1 wherein the first part forms a resiliently deformable wall, and wherein the pin and the bistable contact element are operatively connected with said wall.

5. Alarm tag according to claim 4 wherein the deformable wall forms a bulge and wherein the pin is attached to the bulge.

6. Alarm tag according to claims 2 or 5 wherein said spring washer forms an aperture therein, and wherein the bulge of the wall forms an annular groove, the edge portion of the spring washer around said aperture being received in said annular groove.

7. Alarm tag according to claim 4, wherein the first part forms a space receiving the alarm device, the resiliently deformable wall forming an outside wall of said space.

8. Alarm tag according to claim 7 further including a circuit board inserted into the space, the electronic control circuit being included in the circuit board, and contacts on said circuit board for co-operation with the bistable contact element located between the circuit board and the resiliently deformable wall.

9. Alarm tag according to claim 1 wherein the electronic control circuit is constructed to be triggered to the second stable position of the contact element for continued activation of the alarm device.

* * * * *

UNITED STATES PATENT AND TRADEMARK OFFICE

CERTIFICATE OF CORRECTION

PATENT NO. : 5,841,349

DATED : November 24, 1998

INVENTOR(S) : Bertil Holmgren

It is certified that error appears in the above-identified patent and that said Letters Patent is hereby corrected as shown below:

Col. 1, line 17
replace "securily"
with --security--.

Signed and Sealed this

Twenty-third Day of February, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,841,349

DATED : November 24, 1998

INVENTOR(S) : Bertil Holmgren

It is certified that error appears in the above-identified patent and that said Letters Patent is hereby corrected as shown below:

Title page, item [73], Assignee: should read -- MW INTERNATIONAL LTD. SURREY, UNITED KINGDOM--.

Signed and Sealed this

Twenty-first Day of September, 1999

*Attest:*

Q. TODD DICKINSON

*Attesting Officer*

*Acting Commissioner of Patents and Trademarks*